US012110743B2

(12) United States Patent
Johnston

(10) Patent No.: US 12,110,743 B2
(45) Date of Patent: Oct. 8, 2024

(54) ADJUSTABLE REAMER

(71) Applicant: Schlumberger Technology Corporation, Sugar Land, TX (US)

(72) Inventor: Stuart Johnston, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/405,349

(22) Filed: Jan. 5, 2024

(65) Prior Publication Data

US 2024/0141732 A1 May 2, 2024

Related U.S. Application Data

(62) Division of application No. 17/817,534, filed on Aug. 4, 2022, now Pat. No. 11,913,285.

(60) Provisional application No. 63/229,823, filed on Aug. 5, 2021.

(51) Int. Cl.
*E21B 10/32* (2006.01)

(52) U.S. Cl.
CPC ..... *E21B 10/322* (2013.01)

(58) Field of Classification Search
CPC ..... E21B 10/322
See application file for complete search history.

(56) References Cited

U.S. PATENT DOCUMENTS

| | | | | |
|---|---|---|---|---|
| 6,732,817 | B2 | 5/2004 | Dewey et al. | |
| 7,048,078 | B2 | 5/2006 | Dewey et al. | |
| 7,314,099 | B2 | 1/2008 | Dewey et al. | |
| 8,555,983 | B2 | 10/2013 | Palacios | |
| 8,826,986 | B2 * | 9/2014 | Wolf | E21B 37/02 166/173 |
| 8,863,843 | B2 | 10/2014 | Wu et al. | |
| 9,926,746 | B2 | 3/2018 | Gao et al. | |
| 2004/0134687 | A1 * | 7/2004 | Radford | E21B 17/1014 175/57 |
| 2005/0145417 | A1 * | 7/2005 | Radford | E21B 4/00 175/269 |
| 2009/0145666 | A1 * | 6/2009 | Radford | E21B 10/345 175/269 |
| 2009/0218092 | A1 * | 9/2009 | Booth | E21B 37/02 166/174 |
| 2013/0087386 | A1 * | 4/2013 | Radford | E21B 47/18 175/57 |
| 2015/0014061 | A1 * | 1/2015 | Wu | E21B 23/006 175/57 |
| 2023/0039209 | A1 | 2/2023 | Johnston | |

* cited by examiner

*Primary Examiner* — David Carroll
(74) *Attorney, Agent, or Firm* — Jeffrey D. Frantz

(57) ABSTRACT

During extension, the reamer block of an expandable reamer pushes on an upper plate. Extension is limited by contact with a spring retainer. To adjust the maximum extension of the expandable reamer, a spacer is placed between the expandable block and the spring retainer. The spacer reduces the amount of longitudinal travel of the expandable reamer, thereby reducing the extension of the expandable reamer.

13 Claims, 8 Drawing Sheets

ADJUSTABLE REAMER

CROSS-REFERENCE TO RELATED APPLICATIONS

This application is a divisional application of U.S. patent application Ser. No. 17/817,534, filed on Aug. 4, 2022, which claims the benefit of, and priority to U.S. Provisional Application No. 63/229,823, filed on Aug. 5, 2021. Each of the above applications is incorporated herein by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

A wellbore may be initially drilled with a first diameter. A portion of the wellbore may be expanded using a reamer. In some embodiments, the reamer may be located uphole of the bit in the same bottom hole assembly. In some embodiments, the reamer may increase the diameter of the wellbore after a pilot hole has been drilled. Some reamers may include reamer blocks that may be selectively expanded to increase the diameter of the wellbore.

SUMMARY

In some embodiments, an expandable tool includes a housing having a longitudinal axis, an expandable block, a resilient member, a spring retainer, and a spacer. The expandable block is at least partially disposed within the housing and is configured to move longitudinally between a retracted configuration and an expanded configuration. The resilient member is configured to bias the expandable block to the retracted configuration. The spring retainer is disposed about the resilient member, and includes a retainer length. The spacer includes a spacer length, and is disposed between the expandable block and the spring retainer. A position of the expandable block along the longitudinal axis in the expanded position is based at least in part on the retainer length and the spacer length.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of a reamer in a retracted configuration, according to at least one embodiment of the present disclosure;

FIG. 2-2 is a longitudinal cross-sectional view of the reamer of FIG. 2-1 in a retracted configuration;

FIG. 2-3 is a longitudinal cross-sectional view of the reamer of FIG. 2-1 in an expanded configuration;

FIG. 2-4 is a longitudinal cross-sectional view of the reamer of FIG. 2-1 in an expanded configuration having a modified expansion distance;

FIG. 3-1 is a plan view of a spacer with a sizing plate, according to at least one embodiment of the present disclosure;

FIG. 3-2 is a plan view of a spacer with a sizing plate, according to at least one embodiment of the present disclosure;

FIG. 3-3 is a plan view of a spacer without a sizing plate, according to at least one embodiment of the present disclosure;

FIG. 4 is a schematic of a plurality of expansion diameters, according to at least one embodiment of the present disclosure.

DETAILED DESCRIPTION

This disclosure generally relates to devices, systems, and methods for adjusting expansion of a reamer block.

Figure 1:
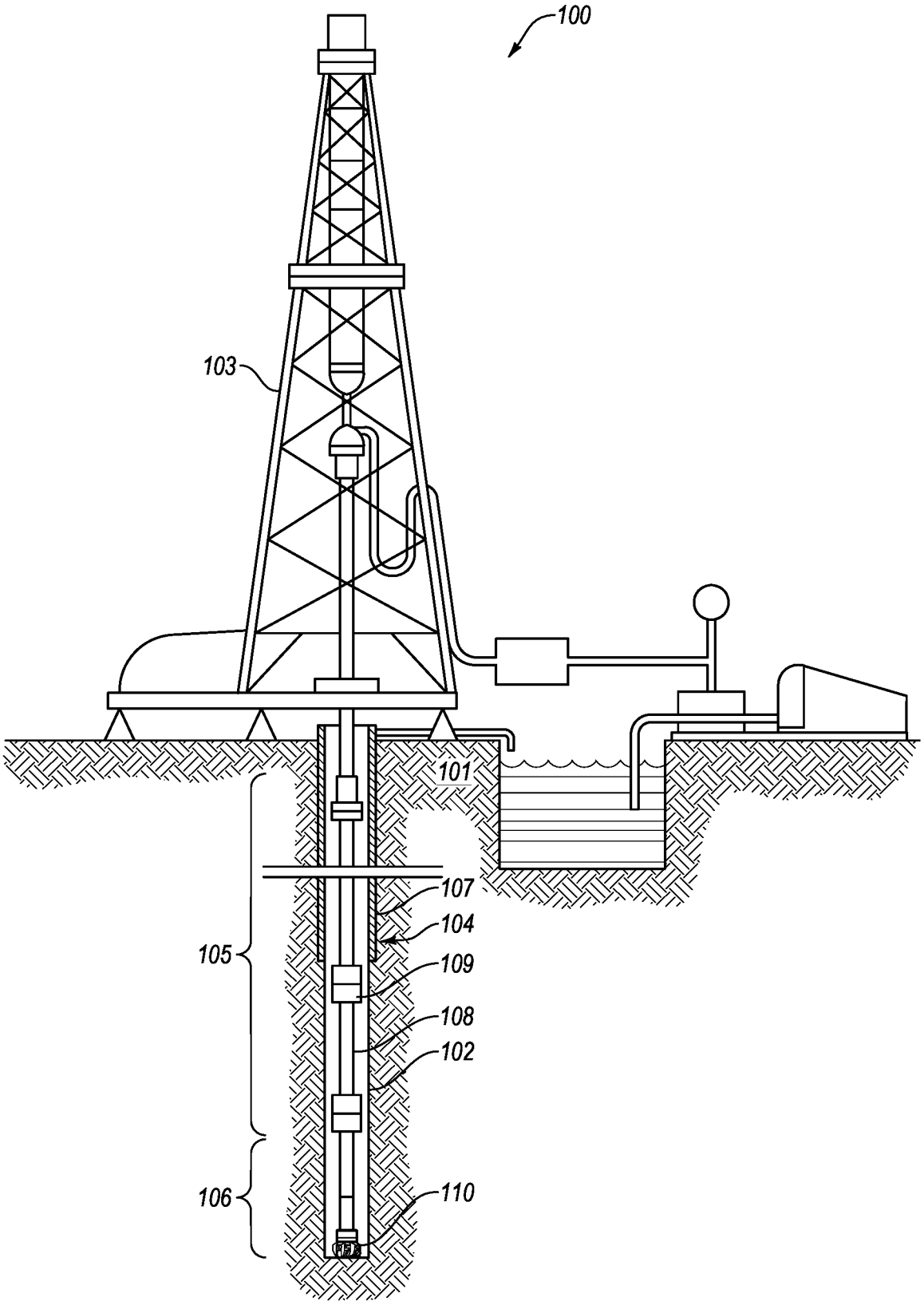
FIG. 1 is representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In some embodiments, the BHA 106 may include one or more expandable tools. Expandable tools may include any tool having a variable diameter, such as stabilizers, reamers, mills, casing cutters, plugs, packers, any other expandable tool, and combinations thereof. An expandable tool may have a retracted diameter and an expanded diameter. In accordance with embodiments of the present disclosure, to change the expanded diameter of the reamer, a technician or drilling operator may insert a spacer between the expandable block of the expandable tool and a spring retainer. The spacer may help to limit the longitudinal movement of the expandable block, thereby limiting the radial expansion of the expandable block.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits and/or rolling cutter bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

Figures 1, 2:
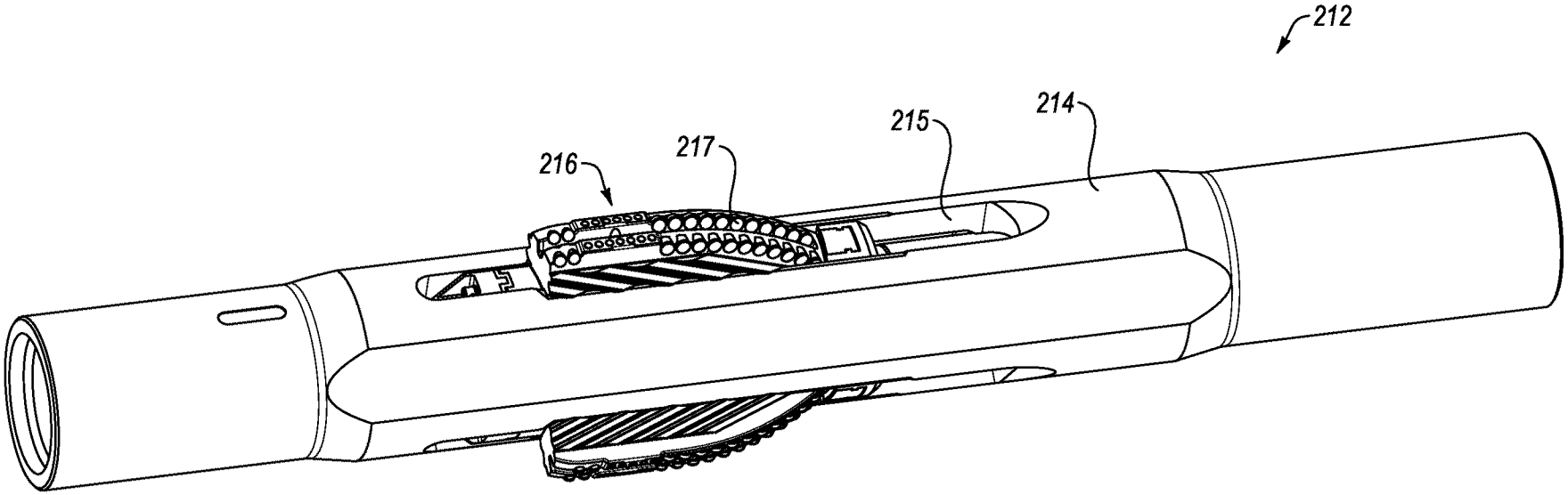
Figure 2:
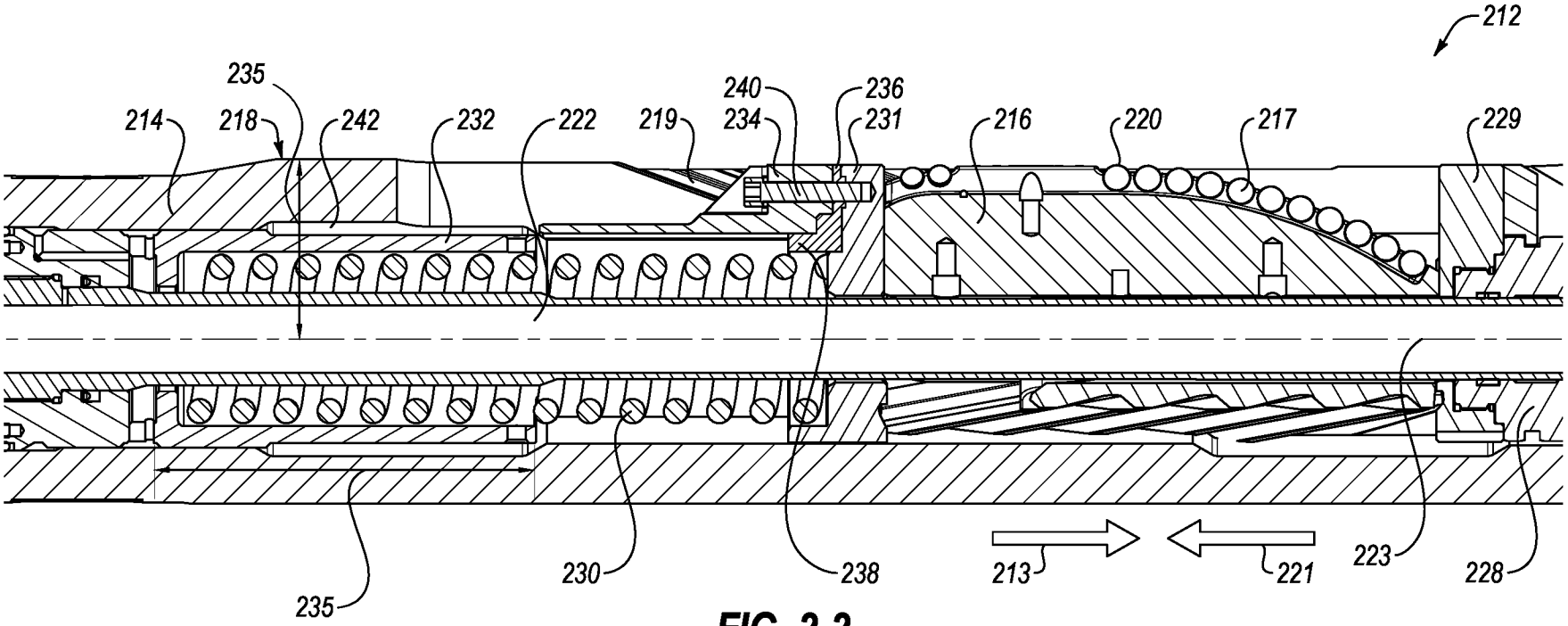

FIG. 2-1 is a perspective view of an expandable tool 212 in retracted configuration, according to at least some embodiments of the present disclosure. The expandable tool 212 includes a housing 214. The housing 214 includes a plurality of openings 215. An expandable block 216 is disposed inside of the housing 214. In the retracted configuration or position shown, the expandable block 216 does not extend out of the opening 215. In the embodiment shown, the expandable block 216 is a reamer block that includes a plurality of cutting elements 217. However, it should be understood that the expandable tool 212 may be any type of expandable tool, and the expandable block 216 may be any type of expandable block 216. For example, the expandable tool 212 may include an expandable stabilizer, and the expandable block 216 may include an expandable stabilizer block. In some examples, the expandable tool 212 may be an expandable cutting tool, and the expandable block 216 may include an expandable cutting block including one or more cutting elements. While embodiments of the present disclosure may be described with respect to a reamer, it should be understood that such embodiments may be applied to any other type of expandable tool.

In downhole drilling operations, a reamer or other cutting tool may be used to increase the diameter of a wellbore. In some situations, a reamer may be located on the same bottomhole assembly (BHA) as a bit. In this manner, as the bit erodes a formation with a bit diameter, the reamer may follow the bit and erode the formation with a reamer diameter. This may allow for larger wellbores to be drilled in a single pass or trip downhole. In other words, the pilot hole may be drilled immediately while reaming the wellbore. In some situations, a reamer may be tripped into an existing wellbore to increase the diameter of the existing wellbore in a different pass or trip than the bit. Put another way, a pilot hole may be drilled before the reamer is inserted into the wellbore.

In some situations, a reamer may be an expandable reamer. In an expandable reamer, a plurality of reamer blocks may expand from a housing to erode the formation. An expandable reamer may have an expanded configuration and a retracted configuration. In the retracted configuration, a cutting surface of the reamer blocks is radially located at or inward from an outer surface of the housing. In this manner, as the reamer is tripped into a wellbore, the reamer blocks may not contact and erode portions of the wellbore wall. In the expanded configuration, the reamer blocks are radially expanded out of the housing so that the cutting surface is located radially outward from the housing. In this manner, as the reamer is rotated, the reamer may erode portions of the wellbore wall and expand the diameter along portions of the wellbore.

FIG. 2-2 is a transverse cross-sectional view of the expandable tool 212 of FIG. 2-1 in the retracted configuration, according to at least one embodiment of the present disclosure. In the retracted configuration, the expandable block 216 is retracted at or below an outer surface 218 of the housing 214. In other words, an outer block surface 220 of the expandable block 216 is located radially inward of the outer surface 218 of the housing 214. The outer block surface 220 in the retracted configuration is less than or equal to the housing distance of the outer surface 218 from the longitudinal axis 223. Thus, the expandable tool 212 in the retracted configuration may not cut or engage the formation or casing, such as while the expandable tool 212 is being tripped into a wellbore.

The expandable block 216 may be expanded using an expansion force. For example, the reamer block may be expanded using a hydraulic pressure differential between an interior of the housing and an exterior of the housing. A flow tube may flow through the housing and past the reamers. The flow tube may include one or more ports into a piston chamber. A piston may be longitudinally movable and connected to the piston chamber. As the pressure from the drilling fluid on the piston increases, the piston may move longitudinally. The piston may push on the reamer blocks, which may slide on rails 219. The rails 219 may be angled radially outward such that as the piston moves the reamer blocks longitudinally, the reamer blocks may move radially outward into the expanded configuration. A resilient member may push against the reamer blocks with a biasing force in the downhole direction 213 that opposes the expansion force applied by the piston. Thus, when the hydraulic pressure on the piston overcomes the biasing force, the reamer blocks may be moved outward to the expanded configuration. In this manner, the reamer may be a hydraulically activated reamer. In other words, to activate the reamer, the pressure of the drilling fluid passing through the flow tube may be increased.

In some embodiments, the reamer may be used while drilling. For example, a reamer may be used while simultaneously drilling a pilot hole. In some embodiments, the reamer may be tripped downhole to cut material after a hole has been drilled. For example, the reamer may cut a section of a casing, may drill through a packer or a plug, or may ream a wider section of the wellbore.

The reamer has an expanded diameter (e.g., the diameter of a circle circumscribed about the outer wall of the reamer blocks in the expanded configuration) and a retracted diameter (e.g., the diameter of a circle circumscribed about the outer surface of the housing in the retracted configuration). The reamer ratio is the ratio between the expanded diameter and the retracted diameter. In some embodiments, the reamer ratio may be in a range having an upper value, a lower value, or upper and lower values including any of 2.5, 2.4, 2.3, 2.2, 2.1, 2.0, 1.9, 1.8, 1.7, 1.6, 1.5, 1.4, 1.3, 1.2, 1.1, or any value therebetween. For example, the reamer ratio may be greater than 1.1. In another example, the reamer ratio may be less than 2.5. In yet other examples, the reamer ratio may be any value in a range between 1.1 and 2.5. In some embodiments, it may be critical that the reamer ratio is greater than 2.0 to sufficiently expand the wellbore diameter.

In some embodiments, the expandable tool may be hydraulically actuated. For example, the reamer may be actuated by increasing the pressure and/or flow rate of the drilling fluid. In some embodiments, the expandable tool may be electromechanically actuated. In some embodiments, the expandable tool may be actuated using any other actuation mechanism. The expandable tool 212 shown includes a flow tube 222 that may flow through a center of the housing 214. The flow tube 222 may run through a longitudinal axis 223 of the housing 214. Fluid flow, such as drilling fluid, flows through the flow tube from left to right in the embodiment shown. The fluid flow may enter a piston chamber (e.g., the piston chamber 225 in FIG. 2-3). A pressure differential between the piston chamber and the exterior of the housing 214 may exert an expansion force on a piston 228 in the piston chamber 225. The piston 228 may transfer the expansion force onto a lower plate 229, which may then transfer the expansion force to the expandable block 216, thereby urging the expandable block 216 in the uphole direction 221.

In some embodiments, a resilient member 230 (e.g., spring) may be arranged around the flow tube 222 and longitudinal axis 223 to apply a biasing force against an upper plate 231. The upper plate 231 may apply a retraction force against the expandable block 216 that opposes the expansion force applied by the piston 228. To transition the expandable tool 212 from the retracted configuration to the expanded configuration, hydraulic pressure pushes on the piston 228, which pushes on the expandable block 216 with an expansion force, thereby urging the expandable block 216 to move longitudinally in the uphole direction 221. This expansion force is resisted by the biasing force of the resilient member 230. Thus, when the expansion force overcomes the biasing force, the expandable blocks 216 are urged longitudinally. The expandable tool 212 may be selectively actuated by increasing the pressure and/or the flow rate of the drilling fluid to increase the expansion force. As the expandable blocks 216 move longitudinally, rails 219 on the opening in the housing 214 direct the expandable blocks 216 radially outward. In the embodiment shown, the resilient member 230 is a coil spring coiled around the flow tube 222. However, in some embodiments, the resilient member 230 may be any other resilient member, including a pneumatic cylinder, a hydraulic cylinder, a linear motor, a compressible material, any other resilient member 230, and combinations thereof.

In the retracted configuration shown in FIG. 2-2, the biasing force by the resilient member 230 on the expandable block 216 is greater than the expansion force, thereby keeping the expandable block 216 in the retracted configuration. When the piston 228 exerts the expansion force in the uphole direction 221 that is greater than the biasing force in the downhole direction 213 on the lower plate 229, the lower plate 229 transfers the expansion force to the expandable block 216, thereby moving the upper plate 231 towards the resilient member 230 and compressing the resilient member 230. A spring retainer 232 (e.g., a resilient member retainer) provides a limit for compression of the resilient member 230.

In some embodiments, the spring retainer 232 may set an expansion limit for the expandable block 216. For example, a retainer length 235 of the spring retainer 232 may determine the expansion distance for the expandable block 216. In some examples, a shorter spring retainer 232 may allow the upper plate 231 to be pushed a further longitudinal distance along the longitudinal axis 223 (e.g., further in the uphole direction 221). Further longitudinal movement of the upper plate 231 enables the expandable block 216 to extend further radially from the housing 214, thereby increasing the diameter of the expandable tool 212 in the expanded configuration. In some embodiments, a longer spring retainer 232 may allow the upper plate 231 to be pushed a shorter amount along the longitudinal axis 223 (e.g., further to the right in the view shown in FIG. 2-2). Lesser longitudinal movement of the upper plate 231 decreases the distance that the expandable block 216 extends radially from the housing 214, thereby decreasing the diameter of the expandable tool 212 in the expanded configuration.

In some embodiments, the longitudinal position of the spring retainer 232 may be adjusted to adjust the expansion distance of the expandable block. For example, the spring retainer 232 may be threaded to the housing 214 and/or the flow tube 222. The longitudinal position of the spring retainer 232 may be adjusted by rotating the spring retainer 232 within the housing 214. In this manner, the expansion distance of the expandable block 216 may be adjusted by adjusting the longitudinal position of the spring retainer 232. The compression of the resilient member 230 when the upper plate 231 or spacer 236 interfaces with the spring retainer 232 may be adjusted by adjusting the longitudinal position of the spring retainer 232.

In the expanded configuration, the expandable block 216 extends from the housing 214 so that the outer surface 220 of the expandable block 216 is located an expansion distance (collectively 233) away from the housing. In some embodiments, the expansion distance may be half of the difference in the expanded diameter of the reamer compared to the retracted diameter of the reamer. In some embodiments, the expansion distance may be in a range having an upper value, a lower value, or upper and lower values including any of 1.5 in. (3.8 cm), 1.6 in. (4.1 cm), 1.7 in. (4.3 cm), 1.8 in. (4.6 cm), 1.9 in. (4.8 cm), 2.0 in. (5.1 cm), 2.1 in. (5.3 cm), 2.2 in. (5.6 cm), 2.3 in. (5.8 cm), 2.4 in. (6.1 cm), 2.5 in. (6.4 cm), 3.0 in. (7.62 cm), 4.0 in. (10.16 cm), 5.0 in. (12.7 cm), 6.0 in. (15.24 cm), 8.0 in. (20.32 cm), 10.0 in. (25.40 cm), 12.0 in. (30.48 cm), 15.0 in. (38.10 cm), 18.5 in. (46.99 cm), or any value therebetween. For example, the expansion distance may be greater than 1.5 in (3.8 cm). In another example, the expansion distance may be less than 18.5 in (46.99 cm). In yet other examples, the expansion distance may be any value in a range between 1.5 in (3.8 cm) and 18.5 in (46.99 cm). In some embodiments, it may be critical that the expansion distance be greater than 2.0 in. (5.1 cm) to sufficiently increase the diameter of the wellbore. In some embodiments, each expandable block 216 may have the same expansion distance. In some embodiments, different expandable blocks 216 may have different expansion distances.

In some situations, a drilling operator may desire to change the expansion distance 233. For example, the drilling operator may desire to ream a different diameter portion of a wellbore, or to re-use the expandable tool 212 in a different wellbore having different wellbore parameters. To save on material costs, the drilling operator may desire to re-use the expandable tool 212 and change the expansion distance 233 of the expandable block 216.

Conventionally, the expansion distance 233 of the expandable block 216 is changed by changing the position of the spring retainer 232 and/or replacing the spring retainer 232 with a spring retainer having a different retainer length. Reducing the retainer length, moving the spring retainer 232 in the downhole direction 213, or enabling more compression of the resilient member may increase the expansion distance 233 of the expandable block 216. However, adjusting the position of the spring retainer 232 and/or replacing the spring retainer 232 may be burdensome and take a lot of time. Indeed, adjusting the position of and/or replacing the spring retainer 232 may involve a partial or full disassembly of the expandable tool 212. Disassembly may provide access to the spring retainer 232 for adjustment or replacement. After the spring retainer is adjusted or replaced, the expandable tool 212 may be reassembled. The reassembly may take up to two or more hours. Furthermore, adjustment or replacement of the spring retainer 232 may be performed in a shop. Transportation of the expandable tool 212 to and from the shop takes additional time and resources. Thus, adjusting the position of and/or replacing the spring retainer 232 may take significant amounts of time and resources.

In accordance with embodiments of the present disclosure, the expansion distance 233 of the expandable block 216 may be adjusted without adjusting, moving, or replacing the spring retainer 232. In the view shown in FIG. 2-3, the expandable tool 212 is expanded with a first expansion distance 233-1. In some embodiments, the maximum possible expansion distance 233 (e.g., the maximum expansion limit) may be the distance between the outer surface 218 of the housing 214 and the outer surface of the expandable block 216 (e.g., with no spacer 236 and with the spring retainer 232 in the uphole-most position). In some embodiments, the expansion distance 233 of the expandable block 216 may be adjusted to a modified expansion distance 233 without disassembling the expandable tool 212. As may be seen in FIG. 2-4, the expandable tool 212 is expanded to a second expansion distance 233-2 (e.g., a modified expansion distance) by the second spacer 236-2, which may be less than the first expansion distance 233-1 enabled by the first spacer 236-1. In the expanded configurations illustrated in FIGS. 2-3 and 2-4, the position of the expandable block 216 along the longitudinal axis is based at least in part on the retainer length 235 and the respective spacer length of the spacer 236. In some embodiments, the expanded configuration interfaces the retainer 232 with the spacer 236. In some embodiments, the second expansion distance 233-2 may be less than the first expansion distance 233-1. In some embodiments, both the first expansion distance 233-1 and the second expansion distance 233-2 may be less than the maximum expansion distance 233.

In some embodiments, the expansion distance 233 of the expandable block 216 may be adjusted without breaking seals, resealing, and pressure testing the expandable tool 212. This may allow a drilling operator or technician to quickly and efficiently change the expansion distance 233 of the expandable block 216 to a modified expansion distance 233 (i.e., intermediate distance) between the maximum expansion limit and the retracted configuration. In the view shown in FIG. 2-4, the second expansion distance 233-2 is a modified expansion distance 233. In some embodiments, this may allow the drilling operator or technician to change the expansion distance 233 of the expandable block 216 at the drilling rig (e.g., not at a shop).

In accordance with embodiments of the present disclosure, the expansion distance 233 of the expandable block 216 may be adjusted by inserting a spacer 236 between the upper plate 231 and the spring retainer 232. The spacer 236 may be used together with the spring retainer 232 to adjust the range of motion for the upper plate 231 to move along the longitudinal axis. When the expandable block 216 is being extended, the spacer 236 spanning the spacer length along the longitudinal axis interfaces with the spring retainer 232, thereby limiting further movement of the expandable block 216 along the longitudinal axis 223.

In some embodiments, the spacer 236 may have a sizing plate 238 extending along the longitudinal axis that limits the expansion distance 233 of the expandable block 216 provided by the spring retainer 232 alone. To change the expansion distance 233 of the expandable block 216, a drilling operator or technician may adjust the length of the sizing plate 238. In this manner, by selecting a spacer 236 having a particular length of sizing plate 238, the expansion distance of the expandable block 216 may be quickly and easily adjusted. For example, in FIG. 2-3, the first spacer 236-1 has a first sizing plate 238-1 and in FIG. 2-4, the second spacer 236-2 has a second sizing plate 238-2. The length of the sizing plate 238 may determine the distance the expandable block 216 may travel in the uphole direction 221. A longer sizing plate 238 may reduce the distance traveled by the expandable block 216 in the uphole direction, thereby reducing the distance traveled radially and the expansion distance 233. As may be seen, the second sizing plate 238-2 is longer than the first sizing plate 238-1, and therefore the second expansion distance 233-2 is less than the first expansion distance 233-1.

In some embodiments, the spacer 236 may be installed with the expandable block 216 set to expand the maximum expansion limit. In this manner, changing the expansion distance 233 may involve replacing a first spacer with a second spacer having a different length sizing plate 238.

In some embodiments, the sizing plate 238 is configured to contact the spring retainer 232 when the expandable tool 212 is in expanded configuration. In some embodiments, the sizing plate 238 may be seamlessly integrated (e.g., integrally formed) with the spacer 236. In some embodiments, the sizing plate 238 may be removably attached to the spacer 236 to allow different lengths sizing plates 238 to be removably attached to the spacer 236.

In some embodiments an expandable tool 212 having a first spacer 236-1 and an associated a first expansion distance 233-1 of the expandable block 216 in the expanded configuration may be changed or replaced with a second spacer 236-2 associated with a second expansion distance 233-2 of the expandable block 216 in the expanded configuration. This may allow the drilling operator to selectively adjust the expansion distance 233 of the expandable block 216 in the expanded configuration by replacing the spacer 236. This may increase the versatility of the expandable tool 212 and reduce the time and cost used to change the expanded diameter of the expandable tool 212.

In FIG. 2-2 when the expandable tool 212 is in retracted configuration a spring cover 234 (e.g., a resilient cover, a resilient member cover) covers the resilient member 230. That is, the spring cover may be disposed radially outside of the resilient member. In the retracted configuration, the spacer 236 and the upper plate 231 may be longitudinally offset from the spring retainer 232. The housing 214 includes a cover cavity 242 wherein the one or more spring covers 234 may slide into when the expandable tool 212 pushes the upper plate 231 towards the resilient member 230 and the spring retainer 232. In some embodiments, the spring cover 234 may help to protect the resilient member 230. For example, the spring cover 234 may help to prevent foreign material from entering the spring cavity, such as drilling fluid, cuttings, swarf, and so forth. In some embodiments, the spring cover 234 is connected to the upper plate 231. In some embodiments, the spring cover 234 may be connected to the upper plate 231 with a fastener 240. In some embodiments, the spacer 236 may be connected to the upper plate 231 between the spring cover 234 and the upper plate 231. In some embodiments, the expandable tool 212 may have one or more spring covers 234. For example, each opening 215 may have a respective spring cover 234.

In some embodiments, to install and/or replace the spacer 236, the spring cover 234 may be disconnected by removing the fastener 240. When the fastener 240 is removed, the spring cover 234 may be removed. The spacer 236 may then be placed on or adjacent to the upper plate 231. The spring cover 234 may be replaced, and the fastener 240 may be inserted through the spring cover 234, the spacer 236, and the upper plate 231. The fastener 240 may then be tightened to secure the spring cover 234, the spacer 236, and the upper plate 231 to each other. This may allow the expansion distance 233 of the expandable block 216 in the expanded configuration to be quickly and easily adjusted. In some embodiments, replacing the spacer 236 by removing the spring cover 234 may be performed in the field, thereby saving time and money.

Figures 2, 3:
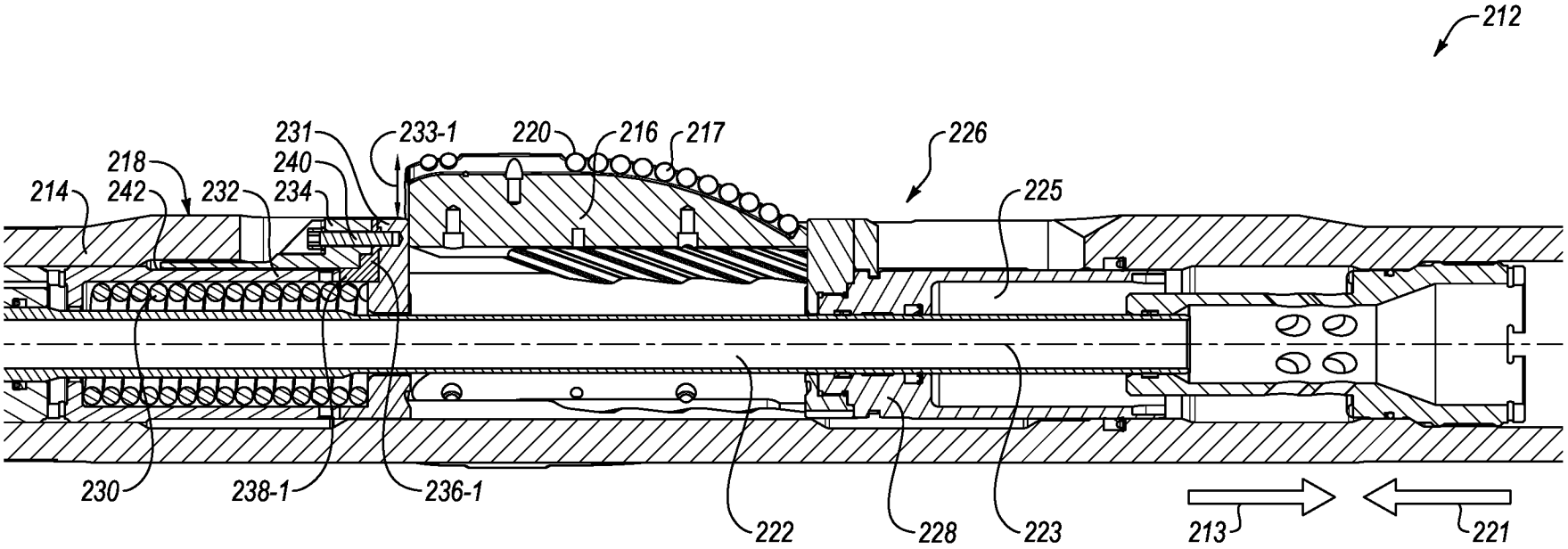

FIG. 2-3 is a transverse cross-sectional view of the expandable tool 212 of FIG. 2-1 in the expanded configuration, according to at least one embodiment of the present disclosure. In the expanded configuration, the outer block surface 220 of the expandable block 216 is expanded past the outer surface 218 of the housing 214. Thus, as the expandable tool 212 is rotated, the cutting elements 217 on the expandable block 216 may engage and degrade the formation, thereby increasing the diameter of the wellbore. The outer surface 218 of the housing 214 may be disposed a housing distance 235 from the longitudinal axis of the tool 212.

To move between the retracted configuration shown in FIG. 2-2 to the expanded configuration shown in FIG. 2-3, the pressure differential between a piston chamber 225 and the exterior of the housing 214 is increased, such as by increasing the volumetric flow rate of the fluid flow through the flow tube 222. This will increase the expansion force on the expandable block 216 by the piston 228 and lower plate 229. When the expansion force becomes greater than the biasing force on the upper plate 231 by the resilient member 230, the expandable block 216 may move in the uphole direction 221, or uphole relative to the housing. One or more rails 219 (e.g., splines) in the housing (not shown in FIG. 2-3) may direct the expandable block 216 radially outward as the expandable block 216 moves longitudinally and pushes the upper plate 231 towards the resilient member 230.

When a piston 228 exerts expansion force onto a lower plate 229, the lower plate 229 transfers the expansion force to the expandable block 216, thereby moving the upper plate 231 towards the resilient member 230 and compressing the resilient member 230. Contact of a spring retainer 232 with a sizing plate 238 may provide the limit for compression of the resilient member 230 and therefore the limit for the expansion distance 233 of the expandable block 216 of the expandable tool 212 in the expanded configuration. In the expanded configuration shown in FIG. 2-3, the expandable tool 212 is fully expanded with the first expansion distance 233-1. As may be seen, in the expanded configuration, the sizing plate 238 is in contact with the spring retainer 232 providing a limit for compression of the resilient member 230, providing a limit for movement along the longitudinal axis 223 of the upper plate 231 and the expandable block 216 in the uphole direction 221. The sizing plate 238 of the spacer 236 may be along a radially inner portion of the spacer 236.

To change the expansion distance of an expandable tool 212 in the expanded configuration, a spacer 236 with a different length sizing plate 238 may be used. To change the spacer 236 a fastener 240 may be removed which holds the spring cover 234 to the spacer 236 and to the upper plate 231. After the fastener 240 is removed, the spring cover 234 may be moved, which fully exposes the spacer 236 when the expandable tool 212 is in retracted configuration. The spacer 236 may be disposed radially outside of the resilient member, and disposed longitudinally along at least a portion of the resilient member 230. The benefit of changing the spacer 236, rather than changing the spring retainer 232, is that removing the spring cover 234 is much quicker than removing one or more of the housing 214, the upper plate 231, and the expandable block 216. Moreover, the spacer 236 may be changed without adjusting or removing the resilient member 230.

In accordance with embodiments of the present disclosure, each expandable block 216 on the expandable tool 212 may have a spacer 236. For example, an expandable tool 212 may include three expandable blocks 216 spaced around the circumference of the expandable tool. Each expandable block 216 may include a spacer 236 located between the respective expandable block 216 and the upper plate 231. The expansion distance 233 of each expandable block 216 may be adjusted by changing the respective spacers 236. In some embodiments, each expandable block 216 may have a spacer 236 with the same size sizing plate 238. This may allow each expandable block 216 to have the same modified expansion distance 233. In some embodiments, different expandable blocks may have spacers 236 that have different sized sizing plates 238, resulting in different expansion distances 233.

FIG. 3-1, FIG. 3-2, and FIG. 3-3 are perspective views of three different types of spacers (collectively 336) having different length sizing plates (collectively 338). FIG. 3-1 shows one example of a first spacer 336-1, having a front side 344, a back side 346, and an opening 348 for a fastener. The front side 344 of the first spacer 336-1 may face the upper plate 231 (shown in FIG. 2-3) and the back side 346 of the first spacer 336-1 may face the spring cover 234 (shown in FIG. 2-3). The first spacer 336-1 may have a first spacer length 339-1, which may be based on the first sizing plate 338-1. The first sizing plate 338-1 may interface with the spring retainer 232 (shown in FIG. 2-3) when the reamer is in expanded configuration. FIG. 3-2 shows another example of a second spacer 336-2, having a longer second sizing plate 338-2 than the first spacer 336-1 shown in FIG. 3-1, resulting in a second spacer length 339-2 of the spacer 336. With a shorter sizing plate, the reamer block may expand further radially outward, than with a longer sizing plate. That is, a first expansion distance of the expandable block associated with the first spacer 336-1 shown in FIG. 3-1 may be greater than a second expansion distance of the expandable block associated with the second spacer 336-2 shown in FIG. 3-2. In this manner, the first spacer 336 may result in a larger expansion distance than the expansion distance resulting from the second spacer 336-2. The upper plate may move further along the longitudinal axis with a shorter sizing plate than with a longer sizing plate. The biasing member may compress more with a shorter sizing plate than with a longer sizing plate.

FIG. 3-3 shows yet another example of a third spacer 336-3 having no sizing plate, resulting in a third spacer length 339-3. When a spacer has no sizing plate, the length of the spring retainer and/or the third spacer length 339-3 of the third spacer 336-3 may be the only thing limiting the reamer block to expand outward. One benefit of using a spacer to limit the reamer block expansion is that during the original assembly, the spring retainer may be set to allow maximum expansion for the reamer in the expanded configuration. If a smaller reamer expansion is required for a specific job, a spacer without a sizing plate may be easily changed to another spacer with a specific length of a sizing plate to limit the expansion distance for expandable blocks of the reamer in the expanded configuration. Another benefit of using a spacer with a sizing plate to limit the expansion distance for the reamer in the expanded configuration is that if a drilling operator or technician desires to increase the diameter of the wellbore, the spacer with a first length of sizing plates can be easily changed to a new spacer having a shorter sizing plate, or no sizing plate. While a single spacer 336 has been discussed herein, it should be understood that an expandable tool may include a spacer 336 for each expandable block. Thus, an expandable tool may have an adjusted expanded diameter based on a set of spacers 336 installed at the reamers.

In some embodiments, an expandable tool may include one or more spacer sets. A spacer set may be a set of spacers that are installed in a single reamer. Each spacer 336 in a spacer set may have the same spacer length 339, and may be associated with a modified expansion distance. By switching out different spacer sets, a drilling operator or technician may quickly and easily change the expansion distance and thereby the expanded diameter of the expandable tool.

Figures 2, 3, 4:
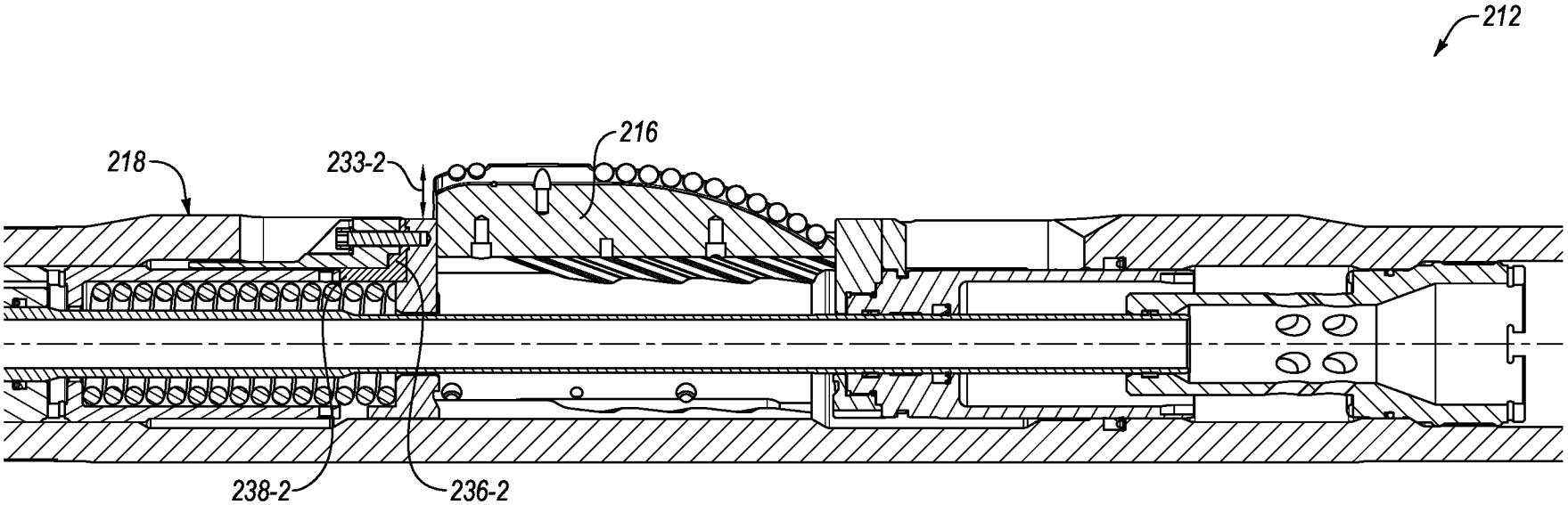
Figure 3:
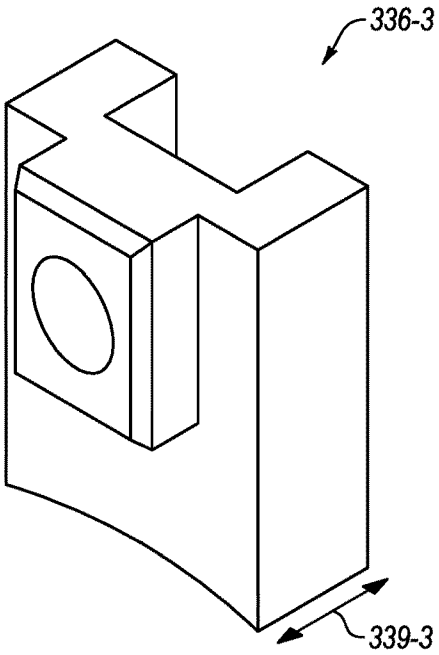
Figures 2, 3:
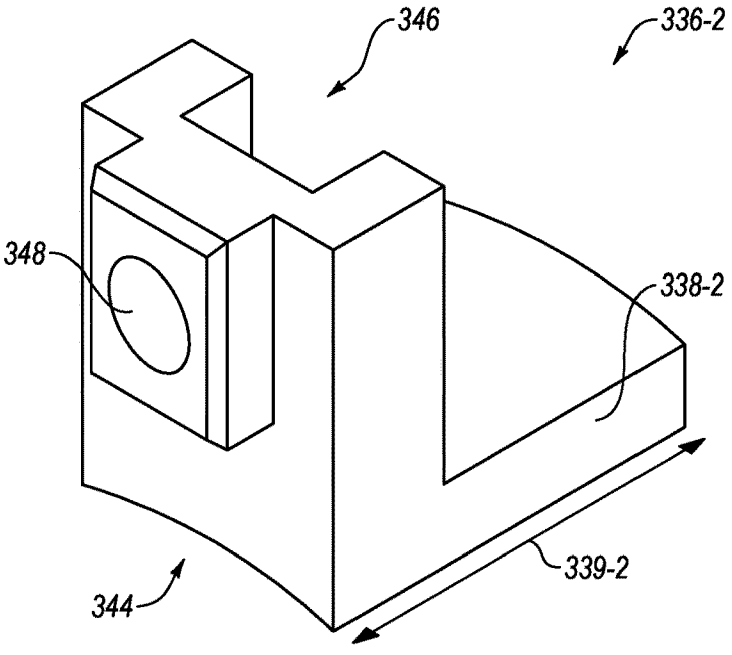
Figures 1, 3:
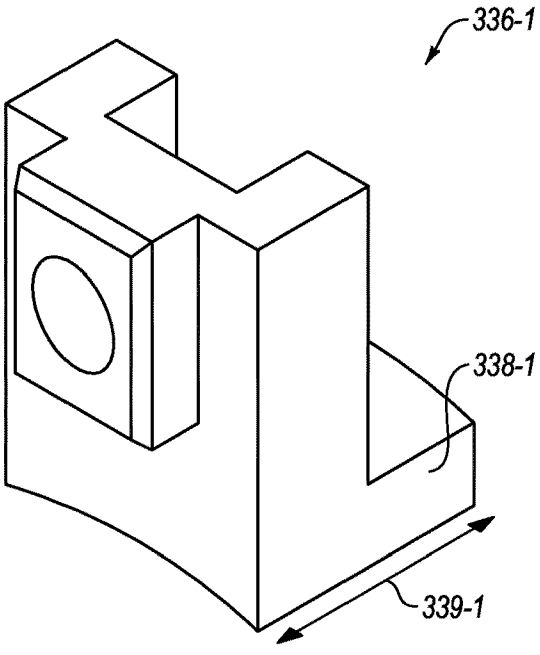
Figure 4:
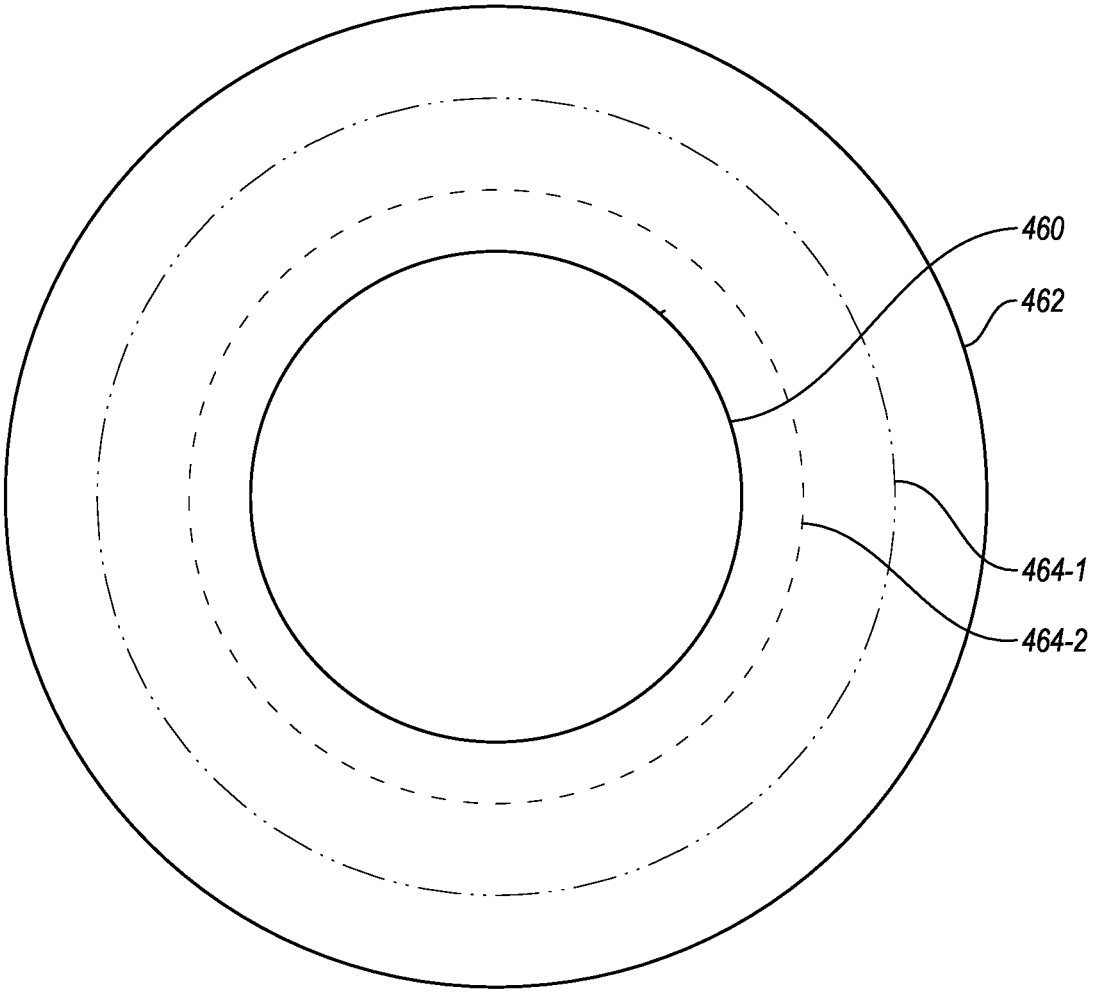

FIG. 4 is a representation of adjustable tool diameters (collectively 464 that may be adjustable between a fully retracted configuration and a maximum expansion limit, according to at least one embodiment of the present disclosure. In a fully retracted configuration, the expandable tool may have a retracted diameter 460. At the maximum expansion limit (e.g., with no spacer or no sizing plate), the expandable tool may have a maximum expansion diameter 462. In some embodiments, the third spacer 336-3 of FIG. 3-3 may be associated with the maximum expansion diameter 462.

By installing spacers between the expandable blocks and the spring cover having different length sizing plates, a modified expansion diameter may be created. For example, the first spacer 336-1 of FIG. 3-1 installed in one or more expandable blocks of the expandable tool may be associated with a first modified expansion diameter 464-1. The second spacer 336-2 of FIG. 3-2 installed in one or more expandable blocks of the expandable tool may be associated with a second modified expansion diameter 464-2. As may be seen, the first modified expansion diameter 464-1 is smaller than the maximum expansion diameter 462, based on the first spacer length 339-1 of the first spacer 336-1 being greater than the third spacer length 339-3 of the third spacer 336-3. Furthermore, the second modified expansion diameter 464-2 is smaller than the first modified expansion diameter 464-1, based on the second spacer length 339-2 of the second spacer 336-2 being greater than the first spacer length 339-1 of the first spacer 336-1. In this manner, by changing the length of one or more spacers of the expandable tool, the expansion diameter of the expandable tool may be adjusted.

Figure 5:
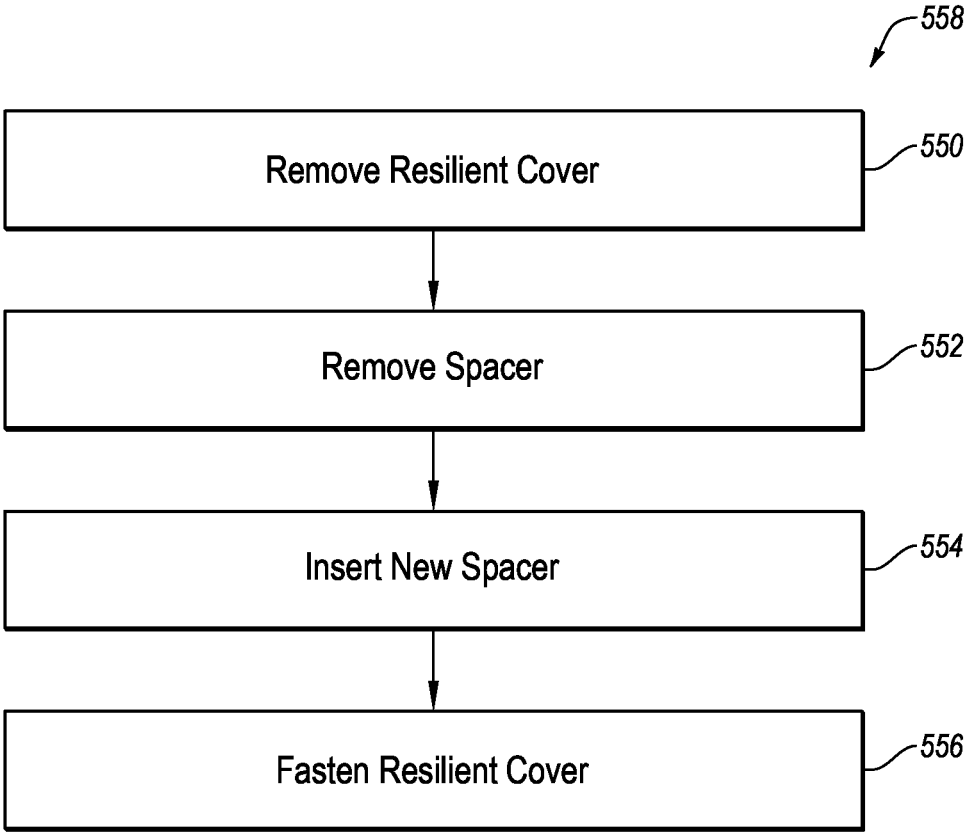
FIG. 5 flow chart, according to at least one embodiment of the present disclosure.

FIG. 5 is a representation of a method 558 for adjusting a reamer block expansion, according to at least one embodiment of the present disclosure. At step 550 the spring cover is removed from the reamer. The spring cover may be fastened to a spacer and to an upper plate with a fastener. After the spring cover has been moved, a spacer may be removed at step 552. At step 554 a new spacer with a different length sizing plate may be inserted. In some embodiments of a reamer without a spacer, the new spacer may be inserted at step 554 immediately after step 550 of removing the spring cover. At step 556 the spring cover may be reattached to the new spacer and the upper plate with the fastener. Accordingly, the expansion distance of the expandable block in the expanded configuration may be adjusted without adjusting the spring retainer. Disassembly time and effort may be greater for adjustment of the spring retainer than for replacement of the spacer for the expandable block.

The embodiments of the expandable tool have been primarily described with reference to wellbore drilling operations; the expandable tools described herein may be used in applications other than the drilling of a wellbore. In other embodiments, expandable tools according to the present disclosure may be used outside a wellbore or other downhole environment used for the exploration or production of natural resources. For instance, expandable tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method comprising:

removing a spring cover from an opening of an expandable tool, wherein the spring cover is disposed radially outside of a resilient member arranged along a longitudinal axis of the expandable tool, wherein removing the spring cover comprises uncoupling the spring cover from an upper plate that interfaces with an expandable block in the opening, and the resilient member is configured to bias an expandable block in the opening to a retracted configuration; and inserting a first spacer between the spring cover and the upper plate, wherein a length of the first spacer along the longitudinal axis limits movement of the expandable block to an expanded configuration.

2. The method of claim 1, wherein the first spacer comprises a first sizing plate disposed radially outside of the resilient member along at least a portion of the resilient member.

3. The method of claim 1, further comprising removing a second spacer between the spring cover and the upper plate, wherein the second spacer is different than the first spacer, a second length of the second spacer along the longitudinal axis limits movement of the expandable block to a second expanded configuration that is different than the expanded configuration corresponding to the first spacer.

4. The method of claim 3, wherein the second spacer has no sizing plate, and an expansion distance of the expandable block in the second expanded configuration is greater than the expansion distance of the expandable block in the expanded configuration corresponding to the first spacer.

5. The method of claim 3, wherein removing the second spacer between the spring cover and the upper plate and inserting the first spacer between the spring cover and the upper plate adjusts an expansion distance of the expandable block without adjusting a spring retainer of the expandable tool.

6. The method of claim 1, wherein removing the spring cover comprises removing a fastener coupling the spring cover to the upper plate.

7. A reamer comprising:

a housing having a longitudinal axis;

a flow tube extending along the longitudinal axis of the housing;

a plurality of reamer blocks arranged radially about the longitudinal axis and configured to extend radially away from the housing an expansion distance based on longitudinal movement of the plurality of reamer blocks;

a spring arranged around the flow tube, the spring configured to bias the reamer blocks to a retracted configuration;

one or more spring covers disposed at least partially about the spring;

an upper plate located between the plurality of reamer blocks and the one or more spring covers, wherein the one or more spring covers is removably connected to the upper plate;

a spring retainer at least partially disposed about the spring, wherein contact of the upper plate and the one or more spring retainers defines a maximum expanded configuration of the expansion distance of the plurality of reamer blocks; and a plurality of spacers removably connectable to the plurality of reamer blocks between the upper plate and the one or more spring covers, wherein the plurality of spacers each comprise a respective length along the longitudinal axis, and wherein contact of the plurality of spacers with the spring retainer defines a modified expansion configuration of the expansion distance of the plurality of reamer blocks that is less than in the maximum expanded configuration.

8. The reamer of claim 7, further comprising a piston configured to bias the expandable block to the expanded configuration in response to a hydraulic pressure differential between the flow tube and an exterior of the housing.

9. The reamer of claim 7, wherein the housing further includes a cover cavity into which the one or more spring covers slides when the plurality of reamer blocks is in the modified expansion configuration.

10. The reamer of claim 7, wherein a sizing plate of each spacer of the plurality of spacers is configured to interface with the spring retainer when the plurality of reamer blocks is in the modified expansion configuration.

11. The reamer of claim 7, wherein the plurality of spacers includes a plurality of spacer sets having different respective lengths, wherein the respective lengths of a first spacer set are associated with a first modified expansion distance and the respective lengths of a second spacer set are associated with a second modified expansion distance.

12. A reamer comprising:

a housing having a longitudinal axis;

a plurality of reamer blocks arranged radially about the longitudinal axis and configured to extend radially away from the housing an expansion distance based on longitudinal movement of the plurality of reamer blocks;

a spring configured to bias the reamer blocks to a retracted configuration;

one or more spring covers disposed at least partially about the spring;

an upper plate located between the plurality of reamer blocks and the one or more spring covers, wherein the one or more spring covers is removably connected to the upper plate;

a spring retainer at least partially disposed about the spring, wherein contact of the upper plate and the one or more spring retainers defines a maximum expanded configuration of the expansion distance of the plurality of reamer blocks; and a plurality of spacers removably connectable to the plurality of reamer blocks between the upper plate and the one or more spring covers, wherein the plurality of spacers each comprise a respective length along the longitudinal axis, wherein contact of the plurality of spacers with the spring retainer defines a modified expansion configuration of the expansion distance of the plurality of reamer blocks that is less than in the maximum expanded configuration, and wherein a sizing plate of each spacer of the plurality of spacers is configured to interface with the spring retainer when the plurality of reamer blocks is in the modified expansion configuration.

13. The reamer of claim 12, wherein the housing further includes a cover cavity into which the one or more spring covers slides when the plurality of reamer blocks is in the modified expansion configuration.

* * * * *